US010883162B2

(12) United States Patent
Shima et al.

(10) Patent No.: US 10,883,162 B2
(45) Date of Patent: Jan. 5, 2021

(54) ALLOY FOR MEDICAL USE, AND METHOD FOR PRODUCING SAME

(71) Applicants: TANAKA KIKINZOKU KOGYO K.K., Chiyoda-ku, Tokyo (JP); KYOTO UNIVERSITY, Kyoto-shi, Kyoto (JP)

(72) Inventors: Kunihiro Shima, Isehara (JP); Kenji Goto, Hiratsuka (JP); Yasushi Masahiro, Tokyo (JP); Asaka Ueno, Tokyo (JP); Hiroo Iwata, Kyoto (JP); Ryusuke Nakai, Kyoto (JP); Tomonobu Kodama, Kyoto (JP)

(73) Assignees: TANAKA KIKINZOKU KOGYO K.K., Tokyo (JP); KYOTO UNIVERSITY, Kyoto (JP)

( * ) Notice: Subject to any disclaimer, the term of this patent is extended or adjusted under 35 U.S.C. 154(b) by 590 days.

(21) Appl. No.: 15/106,508

(22) PCT Filed: Jan. 30, 2014

(86) PCT No.: PCT/JP2014/052072
§ 371 (c)(1),
(2) Date: Jun. 20, 2016

(87) PCT Pub. No.: WO2015/093064
PCT Pub. Date: Jun. 25, 2015

(65) Prior Publication Data

US 2017/0029927 A1 Feb. 2, 2017

(30) Foreign Application Priority Data

Dec. 20, 2013 (JP) ..... 2013-264325

(51) Int. Cl.
*C22C 5/02* (2006.01)
*C22C 5/04* (2006.01)
*C22F 1/14* (2006.01)

(52) U.S. Cl.
CPC . *C22F 1/14* (2013.01); *C22C 5/02* (2013.01)

(58) Field of Classification Search
None
See application file for complete search history.

(56) References Cited

U.S. PATENT DOCUMENTS 3,529,959 A * 9/1970 Darling ..... C03B 37/095 148/538
5,472,333 A * 12/1995 van der Zel ..... C03B 37/095 148/405
2012/0035632 A1* 2/2012 Hamada ..... A61L 31/022 606/157

FOREIGN PATENT DOCUMENTS

EP 0598431 A1 5/1994
GB 456743 A 11/1936
(Continued)

OTHER PUBLICATIONS

EP, Extended Search Report for EP Application No. 14871293.8, dated Apr. 26, 2017.
(Continued)

*Primary Examiner* — Colleen P Dunn
*Assistant Examiner* — Anthony M Liang
(74) *Attorney, Agent, or Firm* — ORRICK, HERRINGTON & SUTCLIFFE LLP; Joseph A. Calvaruso; K. Patrick Herman

(57) ABSTRACT

The present invention provides an alloy for medical use including an Au—Pt alloy, in which the Au—Pt alloy has a Pt concentration of 24 mass % or more and less than 34 mass % with the balance being Au, and has at least a material structure in which a Pt-rich phase having a Pt concentration
(Continued)

higher than that of an α-phase is distributed in an α-phase matrix, the Pt-rich phase has a Pt concentration that is 1.2 to 3.8 times the Pt concentration of the α-phase, and the Pt-rich phase has an area ratio of 1 to 22% in any cross-section. This alloy is an artifact-free alloy material that exhibits excellent compatibility with a magnetic field environment such as an MRI and has magnetic susceptibility of ±4 ppm with respect to magnetic susceptibility of water.

5 Claims, 4 Drawing Sheets

(56) References Cited

FOREIGN PATENT DOCUMENTS

| | | | |
|---|---|---|---|
| GB | 1112766 | A | 5/1968 |
| JP | 56-49534 | A | 5/1981 |
| JP | 6-112258 | A | 4/1994 |
| JP | 10-216518 | A | 8/1998 |
| JP | 4523179 | B2 | 6/2010 |
| JP | 2010-536491 | A | 12/2010 |
| WO | WO 99/65623 | A1 | 12/1999 |
| WO | WO 2004/090180 | A1 | 10/2004 |
| WO | WO 2010/084948 | A1 | 7/2010 |

OTHER PUBLICATIONS

PCT, International Search Report for PCT/JP2014/052072, dated Apr. 22, 2015.

* cited by examiner

MAGNIFIED
PRECIPITATED PHASE

MAGNIFIED
PRECIPITATED PHASE

ALLOY FOR MEDICAL USE, AND METHOD FOR PRODUCING SAME

TECHNICAL FIELD

The present invention relates to an alloy for medical use, specifically to an alloy suitable for a medical appliance such as an embolus treatment coil, and more specifically, to an alloy in which an artifact hardly occurs in a magnetic field environment such as a magnetic resonance image diagnosis apparatus (MRI).

BACKGROUND ART

A material for medical use applied to a medical appliance such as an embolization coil, a clip, a catheter, a stent, or a guide wire requires characteristics such as biocompatibility, corrosion resistance, and workability. Regarding these requirements, for example, stainless, a Co—Cr alloy, and a Pt—W alloy have been practically used as a metal material (see Patent Document 1).

Recently, with the widespread of therapy and surgery using a magnetic resonance image diagnosis apparatus (MRI) in a medical practice, there is a growing concern over an influence on constituent materials of the medical appliance in a magnetic field environment. Examples of material characteristics considering the magnetic field environment include magnetic susceptibility. The magnetic susceptibility of the material is problematic because it can be a factor of an artifact (false image) of the MRI. The artifact is a phenomenon in which an MRI image is distorted due to a difference between magnetic susceptibility of a metal in a magnetic field and magnetic susceptibility of the biopsy tissue in a peripheral region of the magnetic field. The occurrence of the artifact hinders accurate surgery and diagnosis. The material for medical use with practical examples has large difference in magnetic susceptibility with the biopsy tissue and thus cannot suppress the artifact.

There are a small number of development examples of an alloy in consideration of an artifact-free. For example, Patent Document 2 discloses a development example of a stent which is applied with an Au—Pd alloy or an Ag—Pd alloy and is compatible with the MRI.

RELATED ART DOCUMENT

Patent Documents

Patent Document 1: JP 2010-536491 A
Patent Document 2: JP 4523179 B2

SUMMARY OF THE INVENTION

Problems to be Solved by the Invention

However, the conventional alloys are made with merely lowering magnetic susceptibility taken into consideration and a criterion of the magnetic susceptibility is obscure. According to the present inventors, these alloys are not actually considered as an artifact-free material.

Here, the embodied criteria required for a material capable of achieving the artifact-free is that the magnetic susceptibility (volume magnetic susceptibility) of the material is approximate to that of a biopsy tissue. Since the magnetic susceptibility of the biopsy tissue results from water as a main constituent, and the magnetic susceptibility of the water is −9 ppm ($-9\times10^{-6}$), the magnetic susceptibility of the biopsy tissue exhibits a slight diamagnetism. Accordingly, the magnetic susceptibility of the artifact-free material is approximate to the magnetic susceptibility (−9 ppm) of the water.

The present invention has been made in view of the above circumstances and provides an alloy material with excellent compatibility with a magnetic field environment such as an MRI and can achieve an artifact-free material. As the specific criterion, the magnetic susceptibility (−13 to −5 ppm) of ±4 ppm with respect to that of the water is applied.

Means for Solving the Problems

As described above, the present invention provides an artifact-free alloy having magnetic susceptibility (volume susceptibility) from −13 ppm to −5 ppm, but this target value indicates slight diamagnetism. Accordingly, the present inventors applied Au as a metal element serving as a base of such a diamagnetic alloy. The reason is that Au is a diamagnetic metal having magnetic susceptibility of −34 ppm and is also excellent in biocompatibility, corrosion resistance, workability or the like, thereby being suitable for a material for medical use. Then, the present inventors have alloyed metals having positive magnetic susceptibility to make the magnetic susceptibility of Au the target value. These alloy elements require the positive magnetic susceptibility as well as biocompatibility and corrosion resistance similarly to Au. The present inventors applied Pt as the alloy element. The reason is that Pt is a metal having magnetic susceptibility of +279 ppm and has the requirement characteristics.

Further, since Pt is easily alloyed with Au and has an α-single phase region as a homogeneous solid solution (see a phase diagram in FIG. 1), Pt is suitable as an alloy element. From the fact that a constituent phase is a single phase, it is assumed that magnetic susceptibility is also uniform and the magnetic susceptibility can be controlled by adjustment of Pt concentration.

The present inventors firstly examined availability of production of an Au—Pt alloy of a single phase (α-phase) and magnetization characteristics thereof and confirmed that the Au—Pt alloy of a single phase can be produced as a supersaturated solid solution from an α-phase region by an appropriate solution treatment. Additionally, the present inventors also confirmed that the magnetic susceptibility of the Au—Pt alloy of the single phase tends to linearly change into a positive side as Pt concentration increases. Here, the magnetic susceptibility of the Au—Pt alloy of the single phase has preferred magnetic susceptibility at the Pt concentration of 34 to 36 mass %; when the Pt concentration is less than 34 mass %, the effect of Pt is insufficient and the magnetic susceptibility is shifted to a negative side from the preferred range, and conversely, when the Pt concentration exceeds 36 mass %, the magnetic susceptibility tends to be shifted to a positive side.

It can be said that the composition range (Pt concentration of 34 to 36 mass %) exhibiting the preferred magnetic susceptibility is extremely narrow. In this regard, both Au and Pt are precious metals that are subject to great price fluctuations, and to exhibit the desired magnetic susceptibility at a broader composition range is preferable in consideration of the cost of the alloy.

Therefore, after having examined a means for controlling the magnetic susceptibility of the Au—Pt alloy at the broader composition range, the present inventors found out that the magnetic susceptibility of the entire alloy can be made suitable by control and precipitation of a Pt-rich phase with respect to the Au—Pt alloy having an α-phase as a matrix and the Pt concentration of less than 34 mass %, and conceived of the present invention.

That is, the present invention is an alloy for medical use composed of an Au—Pt alloy, wherein the Au—Pt alloy has a Pt concentration of 24 mass % or more and less than 34 mass % with a balance being Au, and has at least a material structure in which a Pt-rich phase having a Pt concentration higher than that of an α-phase is distributed in an α-phase matrix, the Pt-rich phase has a Pt concentration that is 1.2 to 3.8 times the Pt concentration of the α-phase, and the Pt-rich phase has an area ratio of 1 to 22% in any cross-section.

The present invention will be described below in detail. As described above, the Au—Pt alloy of the present invention adjusts the magnetic susceptibility of the entire alloy to a preferred range by precipitating a predetermined amount of the Pt-rich phase into the α-phase, in which the Pt concentration is in the range of 24 mass % or more and less than 34 mass %. For the description of a mechanism of the adjustment of the magnetic susceptibility, the α-phase serving as the matrix has the Pt concentration of less than 34 mass %, and the magnetic susceptibility is on the negative side from the preferred range as described above. Meanwhile, the Pt-rich phase as a precipitated phase is the Au—Pt alloy which has a higher Pt concentration than that of the α-phase, but when the magnetic susceptibility (+279 ppm) of Pt is considered, the magnetic susceptibility of the precipitated phase has positive magnetic susceptibility. Accordingly, the magnetic susceptibility of the alloy is shifted to the positive side as compared to the alloy of the single phase by distribution of the precipitated phase, and the magnetic susceptibility can be adjusted to the preferred range by the appropriate distribution amount of the precipitated phase.

Specifically, the Pt-rich phase as the precipitated phase distributed into the α-phase is the Au—Pt alloy which has the Pt concentration that is 1.2 to 3.8 times the Pt concentration of the α-phase. The composition of the Pt-rich phase to be precipitated varies depending on the alloy composition of the Au—Pt alloy, and will be described below.

Additionally, the distribution amount of the Pt-rich phase is set such that an area ratio occupied by the Pt-rich phase in any cross-section of the alloy is 1 to 22% with respect to the entire area. However, the distribution amount of the Pt-rich phase is a factor to be adjusted by the composition.

The "area ratio" in the present invention means an area ratio with respect to a observation visual field when the alloy structure is observed in any cross-section. Here, "any cross-section" means that a cutting site or a cutting direction is not specified at the time of observation. Furthermore, the Au—Pt alloy of the present invention specifies the predetermined area ratio of the precipitated phase, but does not set the observation visual field to intentionally exclude the precipitated phase. It is preferable to set the observation visual field in the range of 10000 to 360000 $\mu m^2$. The area ratio of the precipitated phase in the alloy may be calculated by use of an average value of area ratios measured in any cross-sections at a plurality of locations.

Here, the composition of the Au—Pt alloy of the present invention can be distinguished by the relation between the range of the Pt concentration and the composition of the Pt-rich phase in the alloy. Specifically, the Au—Pt alloy of the present invention has the preferred magnetic susceptibility for two types of alloy compositions, for example, (1) an alloy composition having Pt concentration of 28 mass % or more and less than 34 mass % and (2) an alloy composition having Pt concentration of 24 mass % or more and less than 28 mass %, by adjusting the composition or the like of the Pt-rich phase. A preferred alloy structure for each type of the composition will be described below.

For example, the Au—Pt alloy of (1) having the Pt concentration of 28 mass % or more and less than 34 mass % has a structure in which a Pt-rich phase (Pt concentration of 45±5 mass %) having a composition approximate to an $\alpha_2$-phase in an Au—Pt phase diagram (see FIG. 1) is distributed. The Pt-rich phase ($\alpha_2$-phase) exhibits a lamella structure directed into a grain (α-phase) from a grain boundary of the alloy by discontinuous precipitation (grain-boundary reaction precipitation). By this precipitation type, the precipitation of the Pt-rich phase ($\alpha_2$-phase) is accompanied by precipitation of the $\alpha_1$-phase as an Au-rich phase. Accordingly, the alloy having this composition range includes three phases of the α-phase serving as a matrix, the $\alpha_1$-phase, and the $\alpha_2$-phase.

However, the $\alpha_1$-phase has low Pt concentration and has extremely less influence on the magnetic susceptibility of the entire alloy. Thus, it is sufficient as long as the distribution amount of the $\alpha_2$-phase as the Pt-rich phase is defined in this composition range. The area ratio of the distribution amount of the $\alpha_2$-phase is preferably 5 to 15% in any cross-section of the alloy. When the area ratio is less than 5%, the magnetic susceptibility of the alloy may be on a further negative side than the preferred range; and when the area ratio exceeds 15%, the magnetic susceptibility may be on a further positive side than the preferred range. By the Pt concentration of the alloy, the magnetic susceptibility of the α-phase as the matrix varies and is shifted to the positive side with the increase of the Pt concentration. Accordingly, it is preferable that the amount of the Pt-rich phase is adjusted by the alloy composition, and that the lower Pt concentration of the alloy is, the greater distribution amount of the Pt-rich phase is.

In the Au—Pt alloy of (2) having the Pt concentration of 24 mass % or more and less than 28 mass %, the Pt-rich phase to be precipitated is tentatively called an $\alpha_2'$-phase, and a phase having a higher Pt concentration than the $\alpha_2$-phase is preferably distributed. In this alloy composition, since the Pt concentration is low, the magnetic susceptibility of the matrix (α-phase) is on a further negative side. In order to shift the magnetic susceptibility of the precipitated phase to the further positive side, the Pt concentration needs to be increased compared to the $\alpha_2$-phase. In this application, the Pt concentration of the $\alpha_2'$-phase in this alloy composition is preferably 86 to 90 mass %.

The precipitation type of the Pt-rich phase ($\alpha_2'$-phase) in this alloy composition is continuous precipitation which differs from the alloy composition (1), and the Pt-rich phase ($\alpha_2'$-phase) is precipitated in a high dislocation density site (including a high dislocation density site formed by introduction of working strain). Thus, the $\alpha_2'$-phase can be obtained by precipitation in grains in addition to grain boundaries. The distribution amount of the $\alpha_2'$-phase is preferable when the area ratio is 10 to 22% in any cross-section of the alloy. When the area ratio is less than 10%, the magnetic susceptibility of the alloy is on a further negative side than the preferred range; and when the area ratio exceeds 22%, the magnetic susceptibility is on a further positive side than the preferred range.

In the Au—Pt alloy having this composition, a concentration gradient of decrease in Au concentration microscopically occurs in a peripheral portion (α-phase) of the Pt-rich phase ($\alpha_2'$-phase) as approaching the interface with the $\alpha_2'$-phase. Accordingly, a phase structure of the alloy strictly includes three phases of "α-phase"+"α-phase having the Au concentration gradient"+"$\alpha_2'$-phase", however, since the α-phase having the Au concentration gradient is microscopic and has a low Pt concentration, the α-phase having the Au concentration gradient has extremely less influence on the magnetic susceptibility of the entire alloy. Accordingly, it is also sufficient as long as the distribution amount of the $\alpha_2$'-phase as the Pt-rich phase is defined in this composition range.

Furthermore, the $\alpha_2$'-phase as the above Pt-rich phase also serves as the Pt-rich phase in the Au—Pt alloy of (1) having the Pt concentration of 28 mass % or more and less than 34 mass %. At this time, the $\alpha_2$'-phase has the Pt concentration of 86 to 90 mass % similarly as described above. Further, the area ratio of the distribution amount of the $\alpha_2$'-phase is preferably 1 to 13% in any cross-section of the alloy. The Au—Pt alloy precipitated by the $\alpha_2$'-phase having the Pt concentration of 28 mass % or more and less than 34 mass % also has a phase structure including "α-phase"+"α-phase having an Au concentration gradient"+"$\alpha_2$'-phase", but the magnetic susceptibility is determined by the distribution amount of the $\alpha_2$'-phase as the Pt-rich phase.

As described above, in the Au—Pt alloy of the present invention, the Pt-rich phase is appropriately precipitated within the composition range of the Pt concentration of 24 mass % or more and less than 34 mass % and thus the magnetic susceptibility can be set to the preferred range. In the Au—Pt alloy having the Pt concentration of less than 24 mass %, the magnetic susceptibility of the α-phase is excessively shifted to the negative side, and thus the magnetic susceptibility of the alloy cannot be suitable even when the action of the Pt-rich phase is considered. Additionally, with respect to the alloy having the Pt concentration of 34 mass % or more, when the Pt concentration is 36% or less, preferred magnetic susceptibility is exhibited in a state of the α-single phase and presence of precipitates results in rather undesirable magnetic susceptibility, and when the Pt concentration exceeds 36 mass %, the magnetic susceptibility is excessively shifted to the positive side even in the state of the single phase and thus the magnetic susceptibility cannot be suitable.

A method for producing the Au—Pt alloy of the present invention will be described. Basic steps of the method for producing the Au—Pt alloy of the present invention include a step of precipitating the Pt-rich phase by a heat treatment of the supersaturated solid solution alloy including the α-phase at 600 to 1000° C.

In the production of the Au—Pt alloy of the present invention, the supersaturated solid solution of the α-single phase is subjected to the heat treatment to control the amount of precipitates (Pt-rich phase) and adjust the magnetic susceptibility. That is, a step of forming the supersaturated solid solution is not required when the purpose is to only precipitate the Pt-rich phase, and even when an alloy obtained by, for example, melting and casting is heated to an α-phase region and is then cooled, the Pt-rich phase can be precipitated, but the amount of the Pt-rich phase to be precipitated will be excessively insufficient. Therefore, the alloy is first treated to be in a state of a supersaturated solid solution of a single phase and is subjected to a heat treatment under heat treatment conditions considering the alloy composition, whereby the Pt-rich phase is precipitated depending on target magnetic susceptibility.

As a method of forming the supersaturated solid solution of the α-single phase in the Au—Pt alloy, there is a general solution treatment in which an alloy ingot produced by, for example, melting and casting, is heated to the α-phase region and is then rapidly cooled. In the general solution treatment, however, a state of the α-single phase is hardly obtained, because a very small amount of $\alpha_2$-phase may be precipitated during the rapid cooling. Additionally, segregation occurs in the alloy ingot obtained by the melting and casting or the like in some cases, resulting in hindering the formation of the single phase. In the present invention, to obtain the supersaturated solid solution alloy of the α-single phase, a single-phase forming treatment to be described below is preferably performed several times on the alloy ingot.

The single-phase forming treatment includes a set of a process of performing cold working on the molten and cast alloy ingot and a process of performing the heat treatment on the worked ingot to the α-phase region temperature or higher depending on the alloy composition. In the single-phase forming treatment, the cold working is a process to destroy the cast structure due to the melting and casting and to facilitate the movement of atoms due to the subsequent heat treatment. Additionally, the heat treatment is a process to eliminate the segregation caused by the casting and to make the phase structure of the alloy be the α-phase, and to return precipitates of the alloy to the α-phase to finally remove the precipitates. When a combination of the cold working and the heat treatment is repeated several times, the segregation is eliminated and the precipitates are removed, whereby a material composition becomes uniform and the phase structure becomes a single phase.

For the description of the single-phase forming treatment in more detail, the cold working may include any of working ways such as cold rolling, cold forging, cold drawing, or cold extrusion. The cold rolling such as groove rolling is preferable. The working ratio in the cold working is preferably 30% or more. The working is performed at a cold temperature (room temperature) because an $\alpha_2$-phase is precipitated during warm working or hot working.

Furthermore, specifically, the heat treatment in the single-phase forming treatment is preferably performed at a heating temperature of 1150 to 1250° C., because the $\alpha_2$-phase is precipitated at the α-phase region temperature or lower. A heating time during the heating is preferably set to be 1 to 24 hours. Moreover, the cooling should be rapidly performed after the heating, and the alloy is preferably put into a cooling medium within three seconds after the heating.

The single-phase forming treatment including the cold working and the heat treatment as described above is preferably performed twice or more, because effects are insufficient when the single-phase forming treatment is performed once, and a homogeneity hindering factor such as segregation may remain. The upper limit of the number of times of execution is not particularly limited, and is preferably twice from the viewpoint of production efficiency.

In the method for producing the Au—Pt alloy of the present invention, the supersaturated solid solution alloy of the α-single phase obtained in the above manner is subjected to the heat treatment to precipitate the Pt-rich phase. The heat treatment for achieving intentional phase separation is performed at a temperature not reaching the α-phase region in the ($\alpha_1$+$\alpha_2$) region in the phase diagram, and a specific temperature range of the heat treatment is 600 to 1000° C. Additionally, a heat treatment time is preferably 1 to 48 hours.

The phase separation due to the heat treatment of the supersaturated solid solution is easily proceeded in the Au—Pt alloy of a relatively high Pt concentration. As described above, the Au—Pt alloy according to the present invention has different compositions of Pt-rich phase and precipitation modes depending on the Pt concentration, and includes two types, that is, (1) the alloy having the Pt concentration of 28 mass % or more and less than 34 mass % and (2) the alloy having the Pt concentration of 24 mass % or more and less than 28 mass %. The phase separation only by the heat treatment is easily proceeded in the supersaturated solid solution of (1) having the Pt concentration of 28 mass % or more and less than 34 mass %, because by the high Pt concentration, the phase separation can be performed at a high temperature at which atoms easily move, and the concentration difference between the α-phase and the separation phase ($\alpha_1$, $\alpha_2$) increases at a low temperature, which becomes a driving force of the phase separation, and thus the phase separation occurs only by application of thermal energy.

When the heat treatment is performed on the supersaturated solid solution of (1) having the Pt concentration of 28 mass % or more and less than 34 mass %, the $\alpha_2$-phase is precipitated as the Pt-rich phase, and at the same time, the $\alpha_1$-phase as the Au-rich phase is precipitated. At this time, the composition of the $\alpha_2$-phase ($\alpha_1$-phase) and the amount of the $\alpha_2$-phase ($\alpha_1$-phase) to be precipitated in the set heat treatment temperature can be estimated by a so-called "lever rule" based on the phase diagram. As described above, as the Pt concentration of the alloy is low in the composition range, the distribution amount of the Pt-rich phase preferably increases. Accordingly, as can be seen with reference to the phase diagram of FIG. 1, in the temperature range (600 to 1000° C.) of the heat treatment, the heat treatment temperature of the alloy having the high Pt concentration is preferably set to a high temperature side, and the heat treatment temperature of the alloy having the low Pt concentration is preferably set to a low temperature side.

Additionally, as a means to cause the phase separation of the supersaturated solid solution subjected to the single-phase forming treatment, the heat treatment and the introduction of working strain can be performed in combination. This means is particularly effective for the supersaturated solid solution alloy of (2) having the Pt concentration of 24 mass % or more and less than 28 mass %. As described above, the heat treatment temperature for the phase separation is preferably set on the low temperature side when the Pt concentration is low, but the diffusion of Pt and Au is delayed when the heat treatment temperature becomes lower. From these factors, the phase separation by only the heat treatment hardly proceeds in the supersaturated solid solution alloy having the Pt concentration of less than 28 mass %. Therefore, the cold working is performed on the supersaturated solid solution alloy, the working strain is made to remain in the material structure, and strain energy is used as a driving force of the phase separation, whereby the phase separation proceeds due to the heat treatment.

With respect to the precipitation of the Pt-rich phase by the phase separation by the combination of the cold working and the heat treatment, the amount of the Pt-rich phase to be precipitated can be mainly controlled by the working ratio during the cold working. The working ratio is preferably 10 to 30%. When the working ratio is less than 10%, the introduction of strain is insufficient and a sufficient Pt-rich phase cannot be obtained. Additionally, when the working ratio exceeds 30%, the Pt-rich phase is precipitated beyond the preferred range and the magnetic susceptibility of the alloy is greatly shifted to the positive side. Examples of the cold working may include any of working ways such as cold rolling, cold forging, cold drawing, or cold extrusion. The cold rolling is preferred.

In the production method including the combination step of the cold working and the heat treatment as described above, the amount of the Pt-rich phase to be precipitated is mainly controlled by setting of the working ratio, and the working ratio is important rather than the heat treatment temperature. The heat treatment temperature is preferably 700 to 900° C., and the heat treatment time is preferably 1 to 12 hours.

As described above, the method of the phase separation including the cold working is particularly useful for the supersaturated solid solution alloy having the Pt concentration of 24 mass % or more and less than 28 mass, and is also useful for the supersaturated solid solution having the Pt concentration of 28 mass % or more and less than 34 mass %. Working conditions and heat treatment conditions are similar to those described above, preferably.

As described above, the Au—Pt alloy of the present invention can be produced by an appropriate heat treatment of the supersaturated solid solution of the α-single phase depending on the composition.

With respect to the melting and casting of the alloy ingot before the production of the supersaturated solid solution, general melting and casting conditions can be applied. The composition of the alloy is adjusted in such a manner of mixing each of an Au metal and a Pt metal to a target composition (Pt: 24 mass % or more and less than 34 mass %), and the mixture can be molten and cast by arc melting, high-frequency heating melting or the like to produce an alloy ingot. Additionally, the molten and cast alloy ingot may be subjected to hot working such as hot forging before the single-phase forming treatment. Fracture of the solidification structure and a segmentation of segregation are previously performed by the hot forging with less deformation resistance, and thus the following single-phase forming treatment becomes more effective. A working temperature at the time of the hot working is preferably set to be 700 to 1050° C. This is because forgeability of the alloy is insufficient and thus cracks may occur during the working when the working temperature is lower than 700° C.

Advantageous Effects of the Invention

As described above, an alloy for medical use composed of an Au—Pt alloy of the present invention has magnetic susceptibility suitable for an artifact-free material. The Au—Pt alloy can be produced in which the Pt concentration is in the range of 24 mass % or more and less than 34 mass %, and has a relatively wide adjustment width of the Pt concentration.

The alloy for medical use of the present invention has also excellent characteristics such as biocompatibility, corrosion resistance, or workability required for the alloy for medical use due to the constituent element. The present invention is suitable for a medical appliance such as an embolic coil, and useful for a medical appliance to be used in a magnetic field environment such as an MRI.

DESCRIPTION OF EMBODIMENTS

Figure 1:
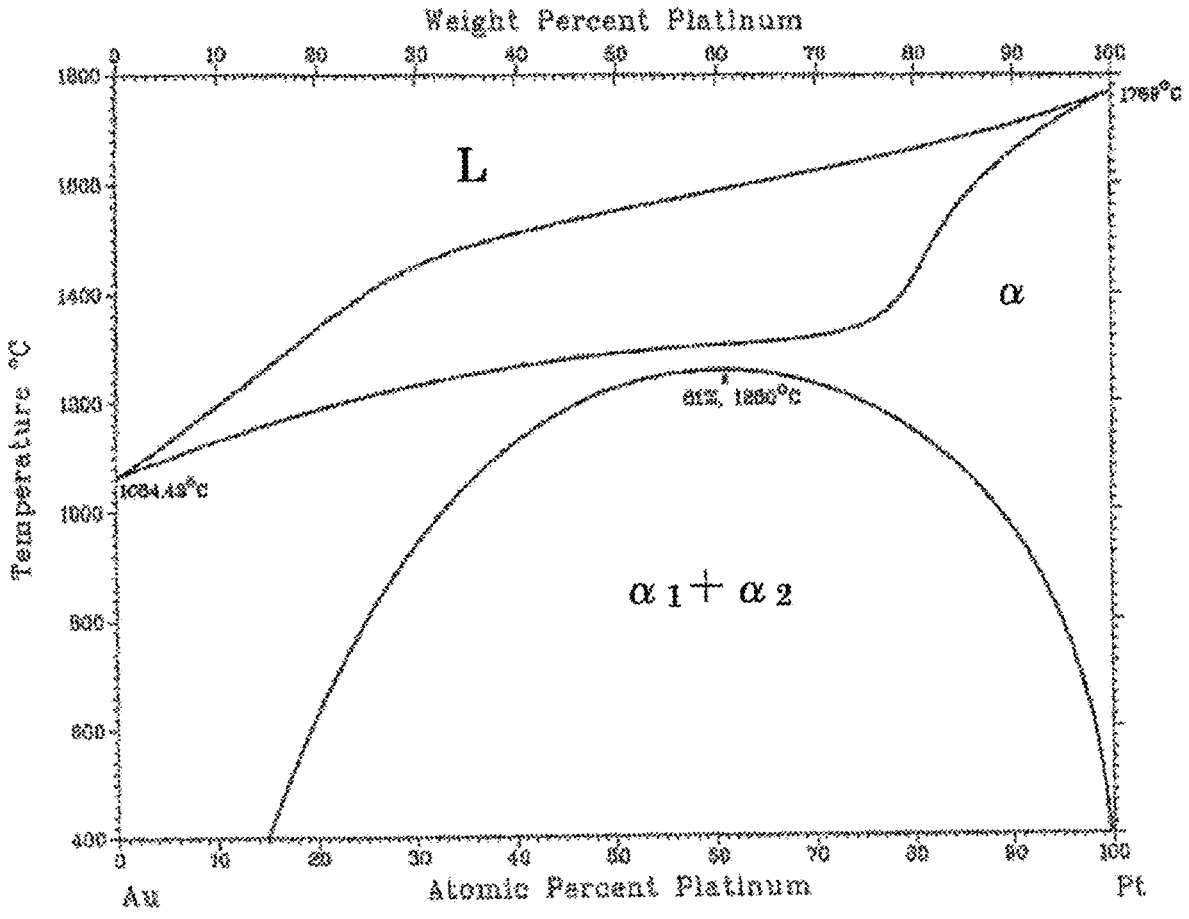
FIG. 1 is a phase diagram of an Au—Pt-based alloy.

Embodiments of the invention will be described below. In the embodiments, examinations were made with respect to magnetic susceptibility measurement and probability of artifact occurrence after producing an Au—Pt alloy ingot with varying Pt concentration and performing a single-phase forming treatment, performing a heat treatment for phase separation on the Au—Pt alloy ingot, and confirming a phase structure of the Au—Pt alloy ingot.

First Embodiment

In this embodiment, an Au—Pt alloy having a Pt concentration of 28 mass % or more and less than 34 mass % was produced. Pure Au and pure Pt (both of them having purity of 99.99%: produced by Tanaka Kikinzoku Kogyo K.K) were weighed to be a target composition and were subjected to high-frequency melting, whereby an alloy ingot was cast. The alloy ingot of 60 g was produced as criteria. The molten and cast alloy ingot was subjected to hot forging. The hot forging was performed at a forging temperature of 1000° C.

Subsequently, the alloy ingot was subjected to a single-phase forming treatment to produce a supersaturated solid solution alloy of an α-single phase. As the single-phase forming treatment, first, the alloy ingot was subjected to cold groove rolling and then was subjected to cold working (working ratio: 40%). Then, the alloy ingot was heated for one hour at 1200° C., and thereafter introduced into ice water to be rapidly cooled. The single-phase forming treatment, which was a combination of the cold working and the heat treatment, was performed three times.

A heat treatment was performed on the alloy subjected to the single-phase forming treatment to precipitate a Pt-rich phase. A temperature of the heat treatment was set between 600° C. and 950° C. In the heat treatment, after being heated, with a time interval, the alloy was introduced into ice water to be rapidly cooled. The heat-treated alloy was subjected to cold groove working to obtain an Au—Pt alloy wire.

With respect to the produced Au—Pt alloy wire, a cross-section was observed by use of an SEM, a structure of the cross-section was observed (observation visual field: 140 μm×100 μm), and an area ratio of an $\alpha_2$-phase of a Pt-rich phase and a total area ratio of an $\alpha_1$-phase and the $\alpha_2$-phase were calculated.

Subsequently, volume magnetic susceptibility was measured. The magnetic susceptibility was measured on each of the alloy samples by use of a superconducting quantum interference device (SQUID) apparatus (7T-SQUID fluxmeter manufactured by Quantum Design, Inc.). A measurement temperature was set to be 37° C. When the measured magnetic susceptibility was in the range of −5 to −13 ppm, which is a target range, it was determined to be acceptable "○", and it was out of the above range, it was determined to be not acceptable "x". Results of the above analysis and measurement were indicated in Table 1, respectively.

TABLE 1

| Alloy composition | Heat treatment: Temperature | Heat treatment: Time | Phase structure: $\alpha_1+\alpha_2$ | Phase structure: $\alpha_2$ | Magnetic susceptibility: Measurement result | Magnetic susceptibility: Determination |
|---|---|---|---|---|---|---|
| Au—28% Pt | Untreated single phase | | 0% | 0% | −22.7 ppm | X |
| | 600° C. | 24 h | 30% | 10% | −10.1 ppm | ○ |
| | 700° C. | 24 h | 25% | 8% | −12.1 ppm | ○ |
| | 700° C. | 36 h | 28% | 9% | −10.9 ppm | ○ |
| | 800° C. | 24 h | 22% | 7% | −15.5 ppm | X |
| | 850° C. | 24 h | 20% | 7% | −19.5 ppm | X |
| | 900° C. | 24 h | 18% | 6% | −20.7 ppm | X |
| Au—30% Pt | Untreated single phase | | 0% | 0% | −20.5 ppm | X |
| | 600° C. | 24 h | 28% | 9% | −6.8 ppm | ○ |
| | 700° C. | 24 h | 25% | 8% | −8.3 ppm | ○ |
| | 800° C. | 24 h | 22% | 7% | −10.1 ppm | ○ |
| | 850° C. | 24 h | 18% | 6% | −11.7 ppm | ○ |
| | 850° C. | 12 h | 18% | 6% | −12.3 ppm | ○ |
| | 900° C. | 24 h | 16% | 5% | −13.8 ppm | X |
| Au—33% Pt | Untreated single phase | | 0% | 0% | −13.9 ppm | X |
| | 600° C. | 24 h | 26% | 9% | −0.6 ppm | X |
| | 700° C. | 24 h | 24% | 8% | −2.8 ppm | X |
| | 800° C. | 24 h | 21% | 7% | −4.2 ppm | X |
| | 850° C. | 24 h | 18% | 6% | −5.7 ppm | ○ |
| | 900° C. | 24 h | 16% | 5% | −6.4 ppm | ○ |
| | 950° C. | 12 h | 14% | 5% | −8.9 ppm | ○ |

Table 1 shows that all of the Au—Pt alloys (Pt concentration: 28 mass %, 30 mass %, and 33 mass %) produced in this embodiment had suitable magnetic susceptibility (−9 ppm±4 ppm) by appropriate setting of a heat treatment temperature and by precipitation of the proper amount of Pt-rich phase ($\alpha_2$-phase) depending on the Pt concentration. Preferred ranges of the distribution amount (area ratio) of the Pt-rich phase ($\alpha_2$-phase) are different from each other by the Pt concentration, but the preferred range in each alloy of this embodiment is 8 to 10% (Pt concentration: 28 mass %), 6 to 9% (Pt concentration: 30 mass %), or 5 to 6% (Pt concentration: 33 mass %), and the Pt-rich phase is reduced with an increase of the Pt concentration. Additionally, the heat treatment temperature for the suitable magnetic susceptibility is 600 to 700° C. (Pt concentration: 28 mass %), 600 to 850° C. (Pt concentration: 30 mass %), or 850 to 950° C. (Pt concentration: 33 mass %), and it is found that the heat treatment temperature preferably rises with the increase of the Pt concentration. In each of the alloys of this embodiment, the $\alpha_2$-phase had the Pt concentration in the range of 45±5 mass %.

Figure 2:
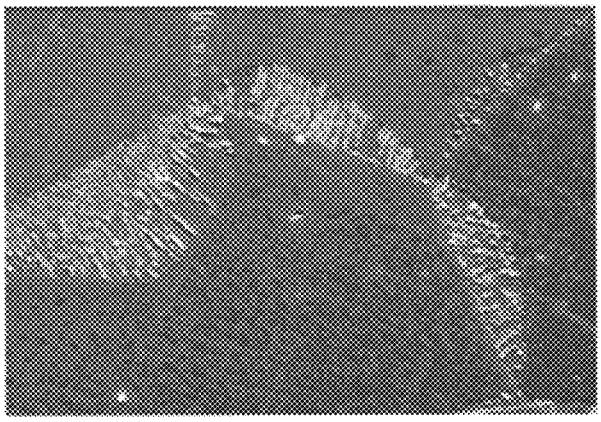
FIG. 2 is an SEM photograph of an Au-28Pt alloy (heat treatment temperature: 900° C.).
Figure 2:
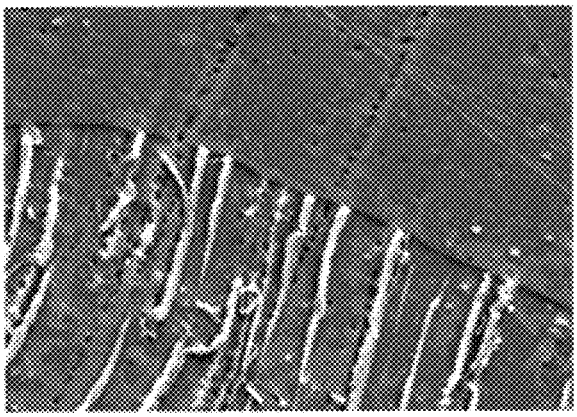

FIG. 2 is an SEM photograph of an Au-28Pt alloy (heat treatment temperature of 900° C.). From the image, a precipitated phase was confirmed to have a lamella shape directed into grains from grain boundaries in the alloy structure. From an EDX analysis of multiple points including precipitates in an image, the precipitated phase was confirmed to be formed in such a manner that the Pt-rich $\alpha_2$-phase and the Au-rich $\alpha_1$-phase were alternately laminated.

Second Embodiment

In this embodiment, an Au—Pt alloy having a Pt concentration of 24 mass % or more and less than 28 mass % was produced. A step of producing an alloy ingot by use of melting and casting and a step of producing a supersaturated solid solution alloy of an α-single phase by a single-phase forming treatment were similar to the steps in the first embodiment.

In this embodiment, the Au—Pt alloy was subjected to cold working prior to a heat treatment for precipitation of a Pt-rich phase, and thus working strain was introduced. The Au—Pt alloy was subjected to cold groove rolling with a working degree of 10 to 30% at room temperature and was worked to an alloy wire. Then, each of the worked alloy wires was a heat treatment, and thus a Pt-rich phase was precipitated. A heat treatment temperature was set to 700 to 850° C.

For each of the samples subjected to the heat treatment, a structure was observed in the same manner as in the first embodiment, and an area ratio of the Pt-rich phase was measured. Additionally, a Pt concentration of the Pt-rich phase was measured by an EDX analysis. Then, magnetic susceptibility of each of the samples was measured. Measurement results were indicated in Table 2.

TABLE 2

| Alloy composition | Working ratio | Heat treatment Temperature | Heat treatment Time | Pt-rich phase Pt concentration | Pt-rich phase Area ratio | Magnetic susceptibility Measurement result | Magnetic susceptibility Determination |
|---|---|---|---|---|---|---|---|
| Au—24% Pt | Untreated single phase | | | — | 0% | −26.3 ppm | X |
| | 0% | 800° C. | 5 h | 44 | 5% | −23.8 ppm | X |
| | 10% | 800° C. | 5 h | 87 | 6% | −20.3 ppm | X |
| | | 850° C. | 5 h | 86 | 8% | −15.2 ppm | X |
| | | 900° C. | 5 h | 89 | 10% | −12.8 ppm | ○ |
| | 20% | 800° C. | 5 h | 90 | 10% | −12.5 ppm | ○ |
| | | 850° C. | 5 h | 87 | 13% | −10.8 ppm | ○ |
| | | 900° C. | 5 h | 88 | 16% | −8.6 ppm | ○ |
| | 30% | 800° C. | 5 h | 86 | 14% | −9.5 ppm | ○ |
| | | 850° C. | 5 h | 87 | 17% | −6.9 ppm | ○ |
| | | 900° C. | 5 h | 89 | 20% | −5.3 ppm | ○ |
| Au—26% Pt | Untreated single phase | | | — | 0% | −24.8 ppm | X |
| | 0% | 850° C. | 5 h | 46 | 4% | −22.8 ppm | X |
| | 10% | 750° C. | 5 h | 86 | 5% | −19.3 ppm | X |
| | | 800° C. | 5 h | 87 | 7% | −16.3 ppm | X |
| | | 850° C. | 5 h | 88 | 10% | −12.3 ppm | ○ |
| | 20% | 750° C. | 5 h | 87 | 7% | −15.9 ppm | X |
| | | 800° C. | 5 h | 88 | 10% | −11.7 ppm | ○ |
| | | 850° C. | 5 h | 89 | 14% | −9.4 ppm | ○ |
| | 30% | 750° C. | 5 h | 87 | 10% | −12.2 ppm | ○ |
| | | 800° C. | 5 h | 88 | 4% | −8.5 ppm | ○ |
| | | 850° C. | 5 h | 89 | 18% | −5.3 ppm | ○ |

From Table 2, it can be confirmed that the alloys having these composition ranges also had suitable magnetic susceptibility after the heat treatment. However, the α-single phase alloy is essentially worked before the heat treatment in the Au—Pt alloys having these composition ranges, the amount of the Pt-rich phase to be precipitated is small and the Pt concentration of the Pt-rich phase is low even when the heat treatment is performed in the absence of the working of the α-single phase alloy, and thus the magnetic susceptibility is on a greater negative side. Additionally, a difference in suitability for the magnetic susceptibility may occur due to the working ratio before the heat treatment.

Figure 3:
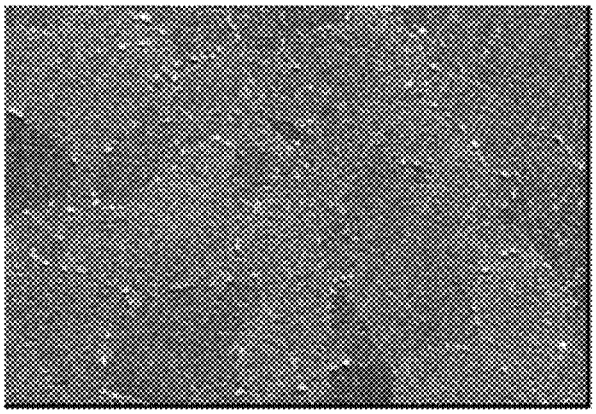
FIG. 3 is an SEM photograph of an Au-26Pt alloy (working ratio: 30%, heat treatment temperature: 850° C.).
Figure 3:
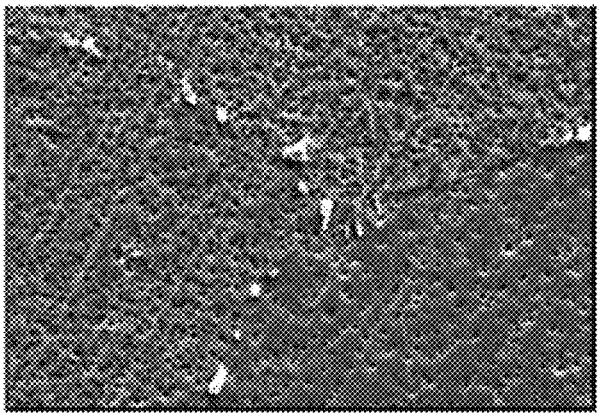

FIG. 3 is an SEM photograph of an Au-26Pt alloy (working ratio: 30%, heat treatment temperature: 850° C.). It was confirmed from the image that, in the alloys having these composition ranges, a granular precipitated phase concentrically remained in grain boundaries and also remained in grains. As indicated in Table 2, the precipitated phase has the Pt concentration in the range of 86 to 90 mass %, which is a higher Pt concentration than the Pt-rich phase ($\alpha_2$-phase) of the alloy of the first embodiment.

Third Embodiment

In this embodiment, an Au—Pt alloy having a Pt concentration of 28 mass % or more and less than 34 mass % was produced by a combination of cold working and a heat treatment as a method of separating phases from a supersaturated solid solution of a single phase. An alloy ingot was produced by melting and casting as in the first embodiment and was subjected to a single-phase forming treatment, the supersaturated solid solution alloy of the single phase was subjected to cold groove rolling with a working degree of 10 to 30% cold working, and the rolled alloy was subjected to a heat treatment at a heat treatment temperature of 750 to 850° C. Thereafter, structure observation, measurement of the Pt concentration of the Pt-rich phase, and measurement of the magnetic susceptibility were performed. The measurement results are indicated in Table 3.

TABLE 3

| Alloy composition | Working ratio | Heat treatment Temperature | Heat treatment Time | Pt-rich phase Pt concentration | Pt-rich phase Area ratio | Magnetic susceptibility Measurement result | Magnetic susceptibility Determination |
|---|---|---|---|---|---|---|---|
| Au—28% Pt | Untreated single phase | | | — | 0% | −22.7 ppm | X |
| | 10% | 700° C. | 5 h | 87 | 3% | −19.8 ppm | X |
| | | 750° C. | 5 h | 88 | 5% | −12.5 ppm | ○ |
| | | 800° C. | 5 h | 89 | 8% | −7.9 ppm | ○ |

TABLE 3-continued

| Alloy composition | Working ratio | Heat treatment Temperature | Heat treatment Time | Pt-rich phase Pt concentration | Pt-rich phase Area ratio | Magnetic susceptibility Measurement result | Magnetic susceptibility Determination |
|---|---|---|---|---|---|---|---|
| | 20% | 700° C. | 5 h | 86 | 4% | −13.7 ppm | ○ |
| | | 750° C. | 5 h | 88 | 8% | −8.2 ppm | ○ |
| | | 800° C. | 5 h | 89 | 11% | −5.0 ppm | ○ |
| | 30% | 700° C. | 5 h | 86 | 8% | −8.5 ppm | ○ |
| | | 750° C. | 5 h | 87 | 11% | −5.2 ppm | ○ |
| | | 800° C. | 5 h | 88 | 14% | −3.8 ppm | X |
| Au—30% Pt | Untreated single phase | | | — | 0% | 20.5 ppm | X |
| | 10% | 650° C. | 5 h | 87 | 2% | −16.1 ppm | X |
| | | 700° C. | 5 h | 87 | 3% | −12.7 ppm | ○ |
| | | 750° C. | 5 h | 88 | 5% | −6.1 ppm | ○ |
| | 20% | 650° C. | 5 h | 86 | 3% | −13.0 ppm | ○ |
| | | 700° C. | 5 h | 88 | 5% | −5.6 ppm | ○ |
| | | 750° C. | 5 h | 88 | 8% | −3.8 ppm | X |
| | 30% | 650° C. | 5 h | 88 | 5% | −5.9 ppm | ○ |
| | | 700° C. | 5 h | 89 | 8% | −3.4 ppm | X |
| | | 750° C. | 5 h | 90 | 11% | 1.2 ppm | X |
| Au—33% Pt | Untreated single phase | | | — | 0% | −13.9 ppm | X |
| | 10% | 600° C. | 5 h | 86 | 1% | −10.6 ppm | ○ |
| | | 650° C. | 5 h | 87 | 3% | −5.6 ppm | ○ |
| | | 700° C. | 5 h | 88 | 4% | −3.1 ppm | X |
| | 20% | 600° C. | 5 h | 87 | 2% | −7.9 ppm | ○ |
| | | 650° C. | 5 h | 87 | 4% | −3.6 ppm | X |
| | | 700° C. | 5 h | 88 | 6% | −0.3 ppm | X |
| | 30% | 600° C. | 5 h | 86 | 3% | −5.8 ppm | ○ |
| | | 650° C. | 5 h | 88 | 6% | 0.8 ppm | X |
| | | 700° C. | 5 h | 90 | 9% | 3.2 ppm | X |

From Table 3, it was confirmed that suitable magnetic susceptibility can also be exhibited in the Au—Pt alloy having the Pt concentration of 28 mass % or more and less than 34 mass % by the combination of the cold working and the heat treatment. Further, for example, an Au-33 mass % Pt alloy cannot exhibit the suitable magnetic susceptibility unless the heat treatment is performed at a temperature of 850° C. or higher (Table 1), but it can be found that the Au-33 mass % Pt alloy can exhibit the suitable magnetic susceptibility even by the heat treatment at 600° C. in combination with the cold working. It is considered that the heat treatment temperature can be lowered by the combination of the cold working during the phase separation.

Among the Au—Pt alloys produced in the above embodiments, for four alloys of the Au-30Pt alloys (subjected to the heat treatment at heat treatment temperature of 850° C. (no working) and not subjected to the heat treatment (no working)) in the first embodiment and the Au-26Pt alloys (subjected to the heat treatment at heat treatment temperature of 800° C. (working ratio: 30%) and not subjected to the heat treatment (no working)) in the second embodiment, whether the artifact is present or not was evaluated by use of an MRI apparatus (Magnetom Sonata 1.5T manufactured by Siemens Inc.). In the test, the alloy sample fixed with an agarose gel in a Pyrex (registered trademark) test tube (ϕ 3.5 mm) was imaged by use of the MRI apparatus and whether the artifact is present or not was visually confirmed. The alloy sample was imaged by use of a gradient echo method (TR: 270 ms, TE: 15 ms) and a spin echo method (TR: 500 ms, TE: 20 ms).

Figure 4:
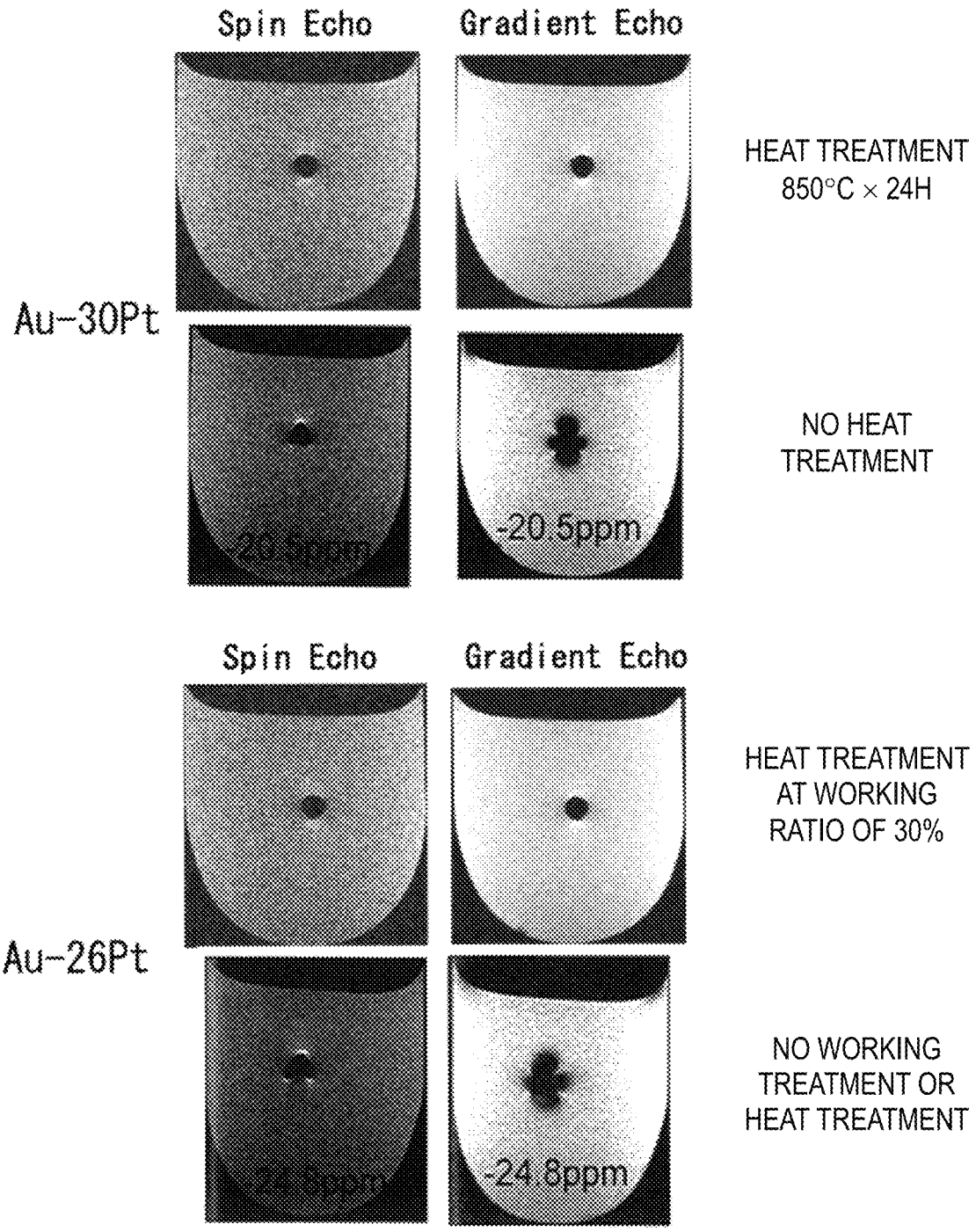
FIG. 4 shows imaging results of the Au-30Pt alloy and the Au-26Pt alloy by an MRI apparatus.

FIG. 4 shows measurement results of each Au—Pt alloy by use of the MRI apparatus. From FIG. 4, the artifact is clearly seen in the Au—Pt alloy in which the phase structure is not adjusted by the heat treatment and the working. In contrast, it can be confirmed that the Au—Pt alloy of this embodiment is free of the artifact.

INDUSTRIAL APPLICABILITY

An alloy for medical use composed of an Au—Pt alloy of the present invention has suitable magnetic susceptibility to suppress an artifact. This alloy has also excellent characteristics such as biocompatibility, corrosion resistance, or workability required for the alloy for medical use. The present invention is useful for a medical appliance such as an embolus coil, a clip, a catheter, a stent, or a guide wire and for a medical appliance to be used in a magnetic field environment such as an MRI.

The invention claimed is:

1. An alloy for medical use consisting of an Au—Pt alloy, wherein the Au has a purity of 99.99 mass % or more and the Pt has a purity of 99.99 mass % or more, wherein the Au—Pt alloy has a Pt concentration of 28 mass % or more and less than 34 mass % with a balance being Au, and has at least a material structure in which a Pt-rich phase having a Pt concentration higher than that of an α-phase is distributed in an α-phase matrix, the Pt-rich phase exhibits a lamella structure directed into a grain from a grain boundary of the Au—Pt alloy, and the Pt-rich phase has a Pt concentration that is 1.2 to 3.8 times the Pt concentration of the α-phase, and the Pt-rich phase has an area ratio of 1 to 22% in any cross-section, and the Au—Pt alloy has magnetic susceptibility from −13 ppm to −5 ppm.

2. The alloy for medical use according to claim 1, wherein the Pt concentration is 28 mass % or more and less than 34 mass %, the Pt-rich phase is distributed as an $\alpha_2$-phase, and the Pt-rich phase has an area ratio of 5 to 15% in any cross-section.

3. The alloy for medical use according to claim 1, wherein the Pt-rich phase has a Pt concentration of 86 to 90 wt %, and the Pt-rich phase has an area ratio of 10 to 22% in any cross-section.

4. The alloy for medical use according to claim 1, the Pt-rich phase has a Pt concentration of 86 to 90 wt %, and the Pt-rich phase has an area ratio of 1 to 13% in any cross-section.

5. The alloy for medical use according to claim 1, wherein the lamella structure comprises an $\alpha_2$-phase as a Pt-rich phase and an $\alpha_1$-phase as an Au-rich phase, and the Au—Pt alloy comprises three phases, with the $\alpha$-phase serving as a matrix, the $\alpha_1$-phase, and the $\alpha_2$-phase.

* * * * *